United States Patent [19]

Schaff

[11] Patent Number: 4,460,288

[45] Date of Patent: Jul. 17, 1984

[54] MULTIDIRECTIONAL LINKING SYSTEM FOR USE IN CONSTRUCTIONS

[76] Inventor: Alfred J. Schaff, 94, Rue de la République, 57300 Marange-Silvange, France

[21] Appl. No.: 231,356

[22] Filed: Feb. 4, 1981

[30] Foreign Application Priority Data

Feb. 6, 1980 [FR] France ..... 80 02591

[51] Int. Cl.[3] ..... E04C 3/04

[52] U.S. Cl. ..... 403/27; 52/105; 52/648; 403/171

[58] Field of Search ..... 52/648, 650, 81, 105, 52/633; 403/171, 172, 176, 27

[56] References Cited

U.S. PATENT DOCUMENTS

| | | | |
|---|---|---|---|
| 1,679,758 | 8/1928 | Bauersfeld et al. . | |
| 2,632,533 | 3/1953 | MacKenzie | 52/633 |
| 3,563,580 | 2/1968 | Black | 403/172 |
| 3,861,107 | 1/1975 | Papayoti | 52/648 |
| 3,962,838 | 6/1976 | Cox | 52/633 |
| 4,122,646 | 10/1978 | Supp | 403/176 |
| 4,148,164 | 4/1964 | Humphrey | 52/105 |

FOREIGN PATENT DOCUMENTS

| | | | |
|---|---|---|---|
| 2444612 | 4/1979 | Fed. Rep. of Germany . | |
| 2079817 | 9/1965 | France . | |
| 2241665 | 3/1966 | France . | |
| 2022647 | 1/1979 | United Kingdom . | |
| 614185 | 6/1978 | U.S.S.R. | 52/648 |
| 620563 | 7/1978 | U.S.S.R. | 403/176 |

*Primary Examiner*—Henry E. Raduazo

*Attorney, Agent, or Firm*—Watson, Cole, Grindle & Watson

[57] ABSTRACT

A system for making spatial structures includes connecting pieces for attaching structural rods. The connection pieces include a central body whereupon two superimposed crowns of lugs are arranged, the lugs of one crown being angularly shifted with respect to those of the other crown. The middle axes of the lugs of the two crowns intersect in one same point situated on the axis of the central body. Such is the geometry of the lugs that they may be pierced in a certain zone as required according to the application contemplated, by using center holes for materializing the central body axis and a reference basis.

7 Claims, 28 Drawing Figures

18
20

19

21

11
17
16
13

12
15
14
17

MULTIDIRECTIONAL LINKING SYSTEM FOR USE IN CONSTRUCTIONS

BACKGROUND OF THE INVENTION

1. Field of the Invention

The invention is concerned with a multidirectional linking system for use in constructions, including a connection piece on which the bars or rods for defining a structure are to be fastened.

2. Description of the Prior Art

The conception and establishment of a structure has to fulfil a number of stability conditions:

those of such a static nature that the lines of force are converging in one point whatever be their angular variation; that the stress flows offer no discontinuities; and that, in the zones of concurrence, stresses are dissipated in the mass without concentration problems;

those of a dynamic nature by reason of the possibility of the isostatic assembling of the components with each other;

steadiness in a fire, by opposing to the collapse at a high temperature of mechanical qualities by an increase of the thicknesses and diameters of the constituent elements.

The establishment of structures is confronted by a number of problems where construction materials are concerned, particularly with regard to the connection pieces. Generally such pieces are made for a specific purpose and differ according to their location in the structure. Such conditions lead to high prices, lengthy implementing and meeting great difficulties in modifying or restoring extant structures.

SUMMARY OF THE INVENTION

One object of the invention is to establish a multidirectional linking system which will possess a large flexibility of use and is made up of a number of standard elements.

The multidirectional linking system for constructions according to the invention including a connection piece whereupon the construction defining bars or rods are to be fastened is noteworthy for such connection piece which includes a central body with lugs arranged along crowns on the central body. The lugs of one crown are angularly shifted with respect to the lugs of another crown. The middle axes of the crown lugs converge at one point situated on the axis of the central body.

The central body may be embodied in at least two superimposable parts, each of them carrying lugs. According to the embodiments, the planes of the lugs either contain or cut the axis of the central body.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

The apparatus developed in accordance with the present invention will now be described in conjunction with the accompanying drawings.

Figure 1:
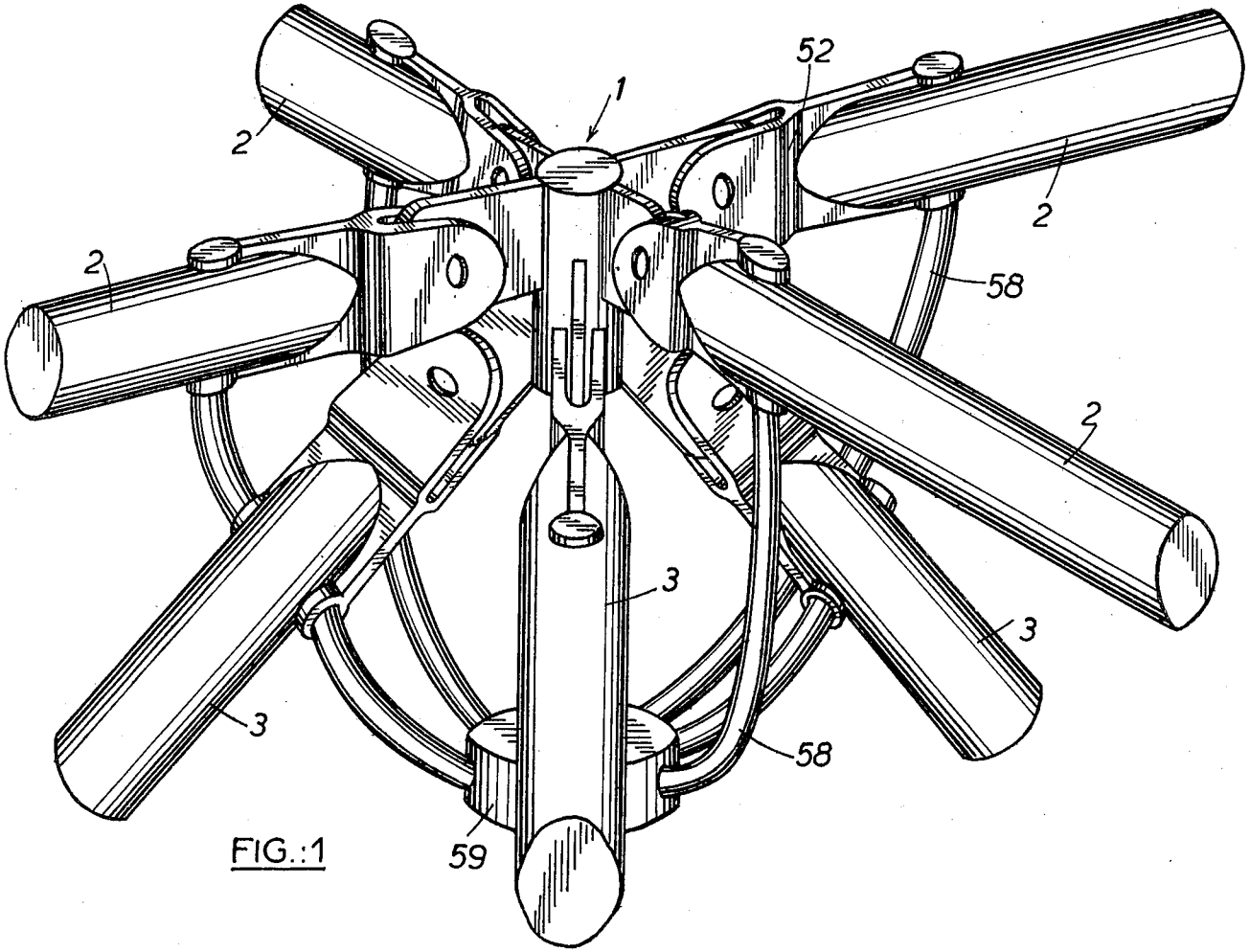
FIG. 1 shows a multidirectional linking system according to the invention.

FIG. 1 which shows a multidirectional linking system for making spatial structures.

The connection piece 1 is a node to which rods 2 and 3, that define the structure to be established, are connected.

Figure 2A:
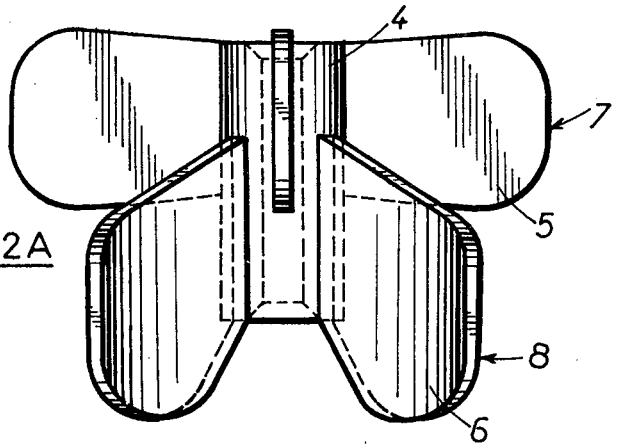
FIGS. 2A and 2B show an example of a connection piece, seen in side view and top view respectively.
Figure 2B:
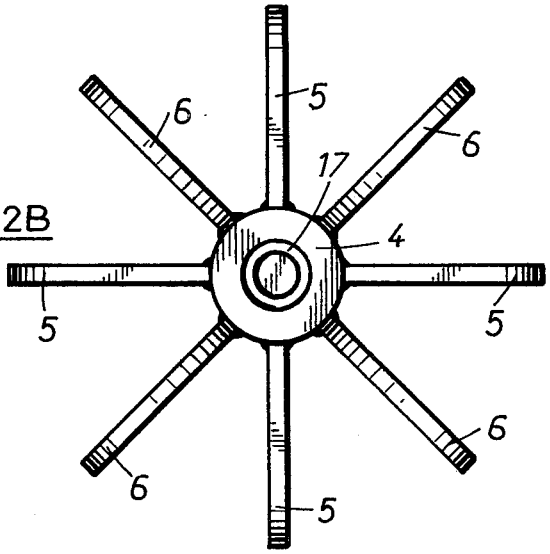

FIGS. 2A and 2B are an elevation view and a top view respectively of a connection piece such as the one seen in FIG. 1. The connection piece includes a central body 4 on which the lugs 5, 6 are fastened, the lugs being arranged as two superimposed crowns 7 and 8, with an angular shift of lugs 5 of crown 7 with respect to lugs 6 of crown 8.

According to a preferred embodiment, the lugs 5 of crown 7 have a symmetrical form which is approximately rectangular, the middle axis that is equidistant from the greater sides intersecting the axis of the central body and the greater sides of the lugs 6 of crown 8 slanting at acute angles from the axis of the central body. The middle axes of lugs 6 are approximately equidistant from the two larger sides and intersect the axis of the central body at the same point as the middle axis of the lugs 5 of crown 7, so that all the axes and lines of force of the structure rods fastened to the lugs concur in one point at the core axis.

The number of lugs in each crown has been arbitrarily taken equal to 4, and the shift angle of the lugs in each crown equal to 45°. in the present example as well as in the following ones the number of lugs in each crown is immaterial, the number of lugs of one crown being not necessarily equal to the number of lugs of the other crown, as the angle shift of the lugs in each crown does not necessarily result in an equidistant distribution of the lugs around the central body as shown in FIG. 2B.

In different application the devices may include two crowns, but by using similar elements it is possible to make devices having three or more crowns.

The embodiment shown in FIGS. 2A and 2B is obtained with, as a basic element, a cylindrical central body 4 around which the lugs are welded. The body 4 and lugs 5, 6 can be formed directly by casting.

Figure 3:
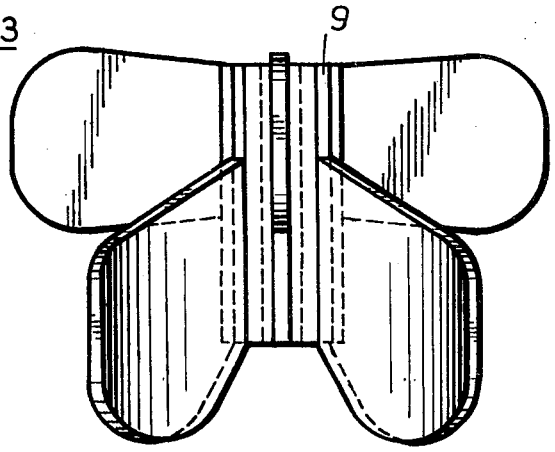
FIG. 3 is a side view of another embodiment of the connection piece.

FIG. 3 shows another embodiment obtained with, as a basic element, a polygonal central body which has hollowed out or relief longitudinal mouldings 9 within which the lugs are slid or abut at their ends and are then fixed by welding or gluing or in any like manner.

Figure 4A:
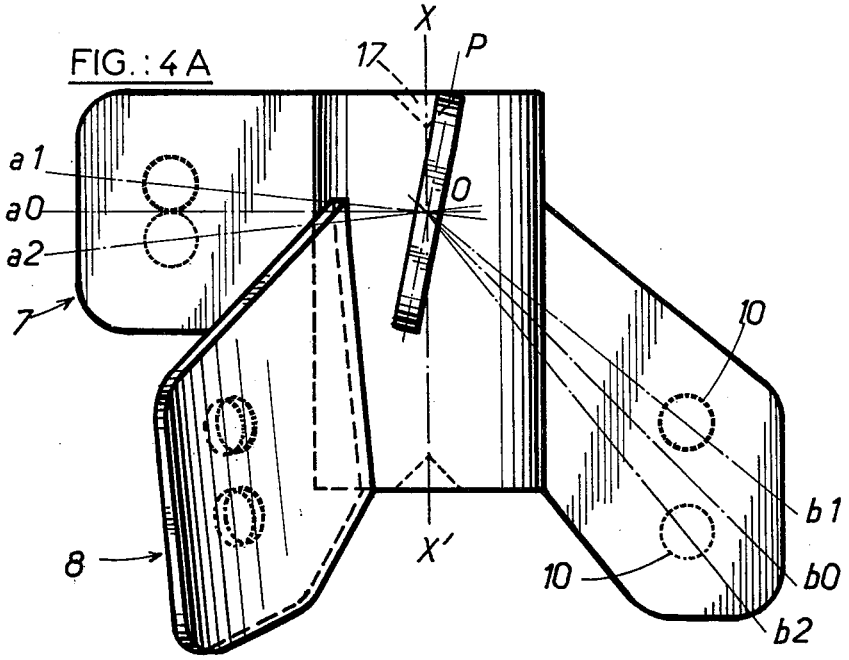
FIGS. 4A and 4B show another embodiment of a connection piece.
Figure 4B:
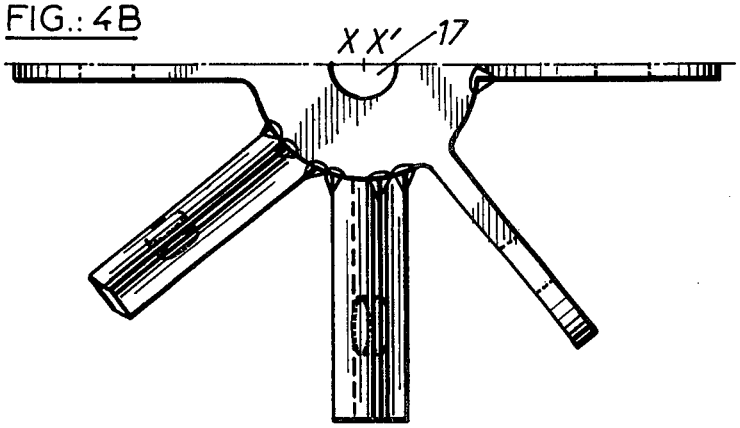

FIGS. 4A and 4B show a connection piece in which the plane P of the lugs meets in an acute angle the axis XX of the central body. For instance while the lugs of the upper crown 7 are inclined clockwise with respect to the body axis, the lugs of the lower crown 8 are inclined counterclockwise.

Figure 7A:
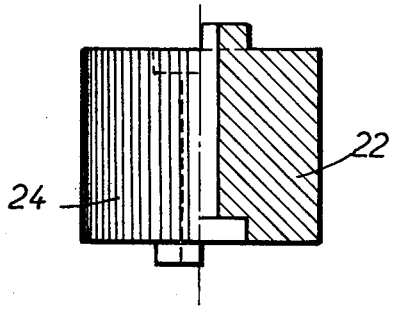
FIGS. 7A–7C show an embodiment of the connection piece, the central body being grooved.
Figure 7B:
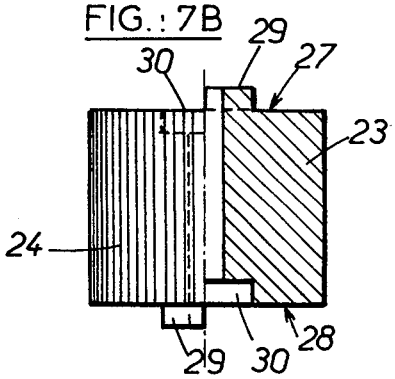
Figure 7C:
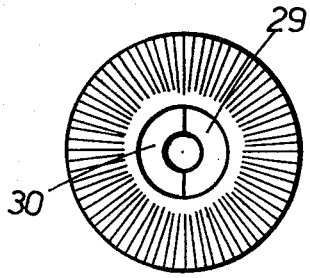
Figure 7D:
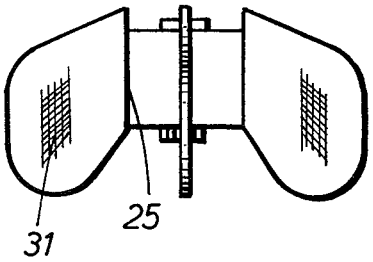
Figure 7E:
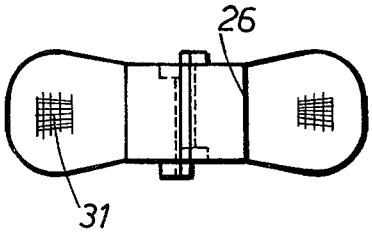

FIG. 4A shows the middle axes $a_0$, $b_0$ of the lugs and two extreme positions $a_1$, $a_2$ and $b_1$, $b_2$. According to a feature of the invention the positions of the axes and the extreme positions may be indicated by marks apposed on the surfaces of the lugs; likewise the intermediate positions 31 may be marked as shown in FIGS. 7D and 7E and as in FIGS. 8A and 9A. Thus it is possible to bore as required the holes 10 provided for the fixation of the structure rods. The axes passing through the marks are established in such manner that the forces transmitted to the lugs concur in one point 0 of the central body. In embodiments not shown all the planes of the lugs of one crown are parallel to the axis of the central body or the planes of a number of lugs in one crown are parallel to the axis of the central body while the planes of the other lugs are inclined.

As indicated beforehand, the lugs are built-up and welded or inserted in grooves, or the whole combination central body and lugs is obtained by casting.

Figures 5A, 5B, 6A, 6B, 6C:
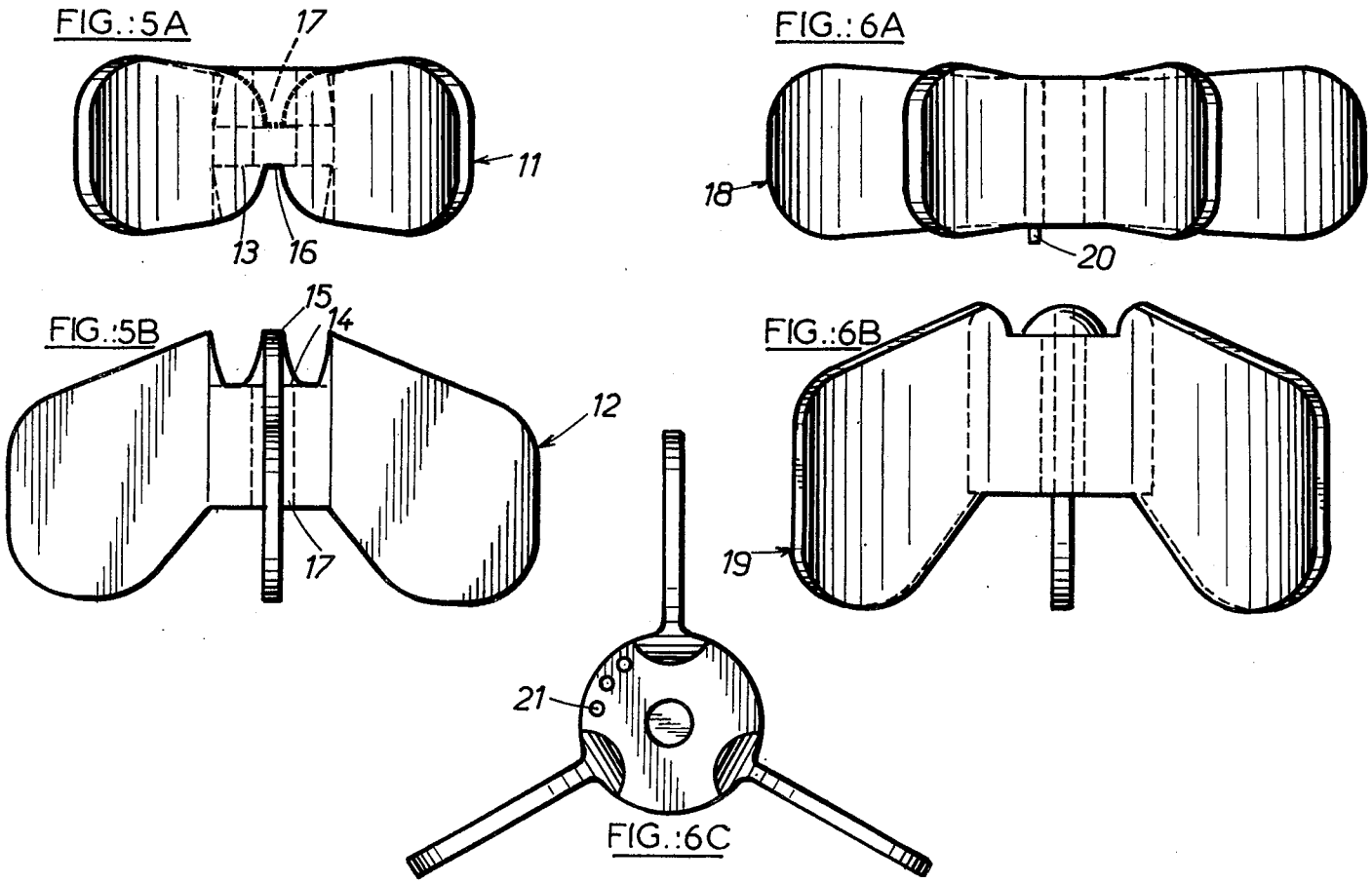
FIGS. 5A and 5B are elevation views of two parts of a connection piece, each part carrying a crown of lugs.
FIGS. 6A, 6B and 6C show views of the two parts of a connection piece which permits choosing the angular shift required between the lugs of the two crowns.

The embodiment of FIGS. 5A and 5B includes a central, separable body made up of at least two crown parts 11 and 12. Each of such parts carries at its periphery the lugs which are either welded or directly produced in a casting procedure.

The cooperating faces 13 and 14 of the two parts of the central body include angular positioning or keying surfaces on one crown with respect to the other crown. In a conventional embodiment a small portion 15 of the lugs of part 12 is inserted in slots 16 provided in crown 11. The parts of the central body have along their axis a center hole (FIGS. 4A–4B) and/or a bore 17 in which a fastening member, for example a bolt, may be introduced, so as to lock both parts in the required position. As its upper end, crown part 11 may have slots shown in interrupted lines similar to slots 16 and receive another constituent crown part 12.

The center holes and/or bores 17 form the axis of the central body and ensure an accurate drilling in the lugs.

Another example of a central body in two parts is shown in FIGS. 6A–6C. Part 18 has six lugs and part 19 (FIG. 6C) has three lugs. Some positioning device, made up for instance of a stud 20 in part 18 and holes 21, allows different angular shifts according to the use of the connection piece. In another embodiment (FIGS. 7A–7E), the central body is made up of two similar parts 22 and 23 (FIGS. 7A and 7B), which have side surfaces provided with a number of grooves 24 that are parallel to the axis of the central body and penetrate into the body (FIG. 7C). The grooves receive or locate the bases 25 and 26 of the lugs which are maintained therein for instance by gluing, the body being preferably made of plastic material. The base surfaces 27 and 28 of the body parts are formed with a stud 29 and a recess 30 shaped as a coaxial half crown. Seen from above, the stud and the recess (FIG. 7C) are arranged as a crown. The body parts that carry the lugs (FIGS. 7D and 7E) are assembled in a known manner so as to form a connection piece. As previously described the faces of the lugs bear marks for locating a drilling zone in the lugs, provided for the attachment of the structure rods.

Figure 8A:
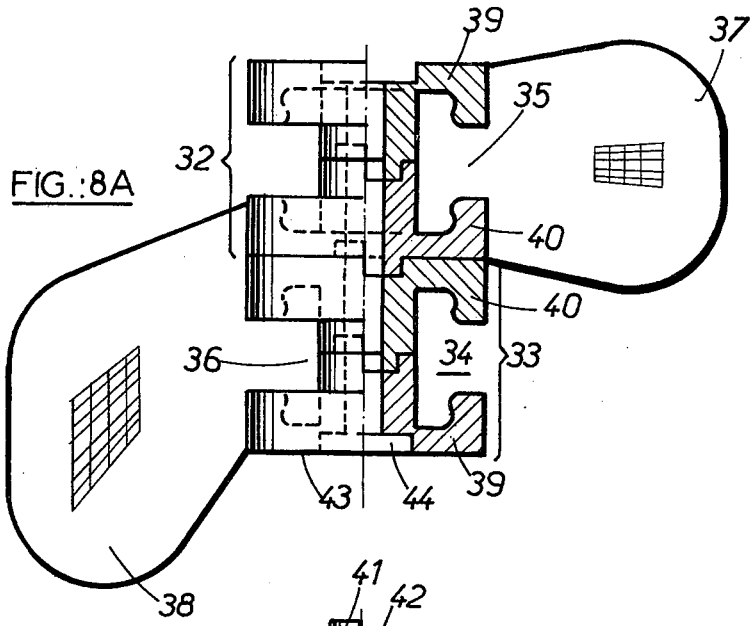
FIGS. 8A–8D show another embodiment of the connection piece.
Figure 8B:
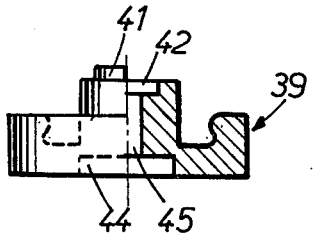
Figure 8C:
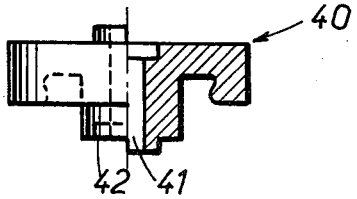
Figure 8D:
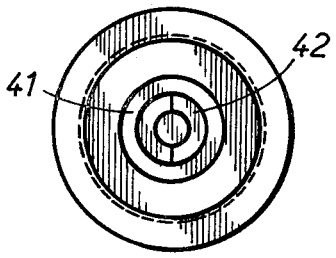

In the example of FIGS. 8A–8D, the central body is made up of at least two parts 32 and 33, each having a peripheral groove 34 whose symmetry plane is perpendicular to the axis of the central body. The groove is wider at its bottom than at the surface of the body. The bases of the lugs 37 and 38 have shapes approximately complementary to those of the grooves with which they cooperate. In this embodiment each part 32, 33 of the central body is made up of two symmetrical or identical pieces 39, 40. Mutual locking of these pieces is obtained through the same manner as those described in connection with the foregoing FIGS. 7A–7E, with two half-crown parts 41 and 42, acting as a stud and a recess (FIG. 8D).

When the pieces are assembled they delimit a groove 34 having an approximately T-shaped cross-section, the cross-bar of the T being parallel to the axis of the central body and situated near the axis thereof. The end portions such as 39 have on their outer free face 43 a recess 44 coaxial with an axial bore 45. The bases 35 and 36 of lugs 37 and 38 are presented to the pieces 40 assembled back to back and are maintained by the end portions 39 when assembling the connection piece. The lugs have the possibility of moving along in the grooves in a plane containing the axis of the central body or eventually at an angle with this axis and, when the rods are fixed, they place themselves in the position of minimal pull.

Figure 9A:
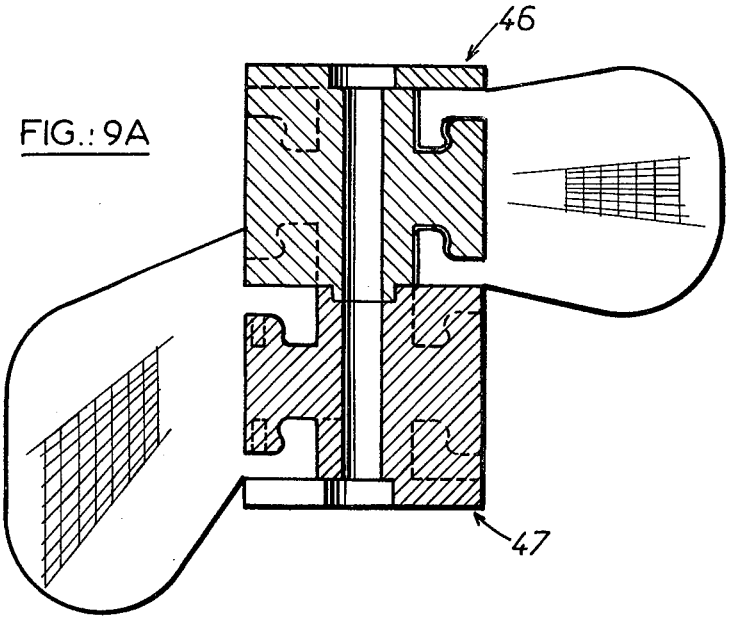
FIGS. 9A–9C show a third embodiment of the connection piece.
Figure 9B:
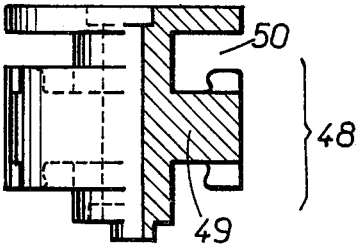
Figure 9C:
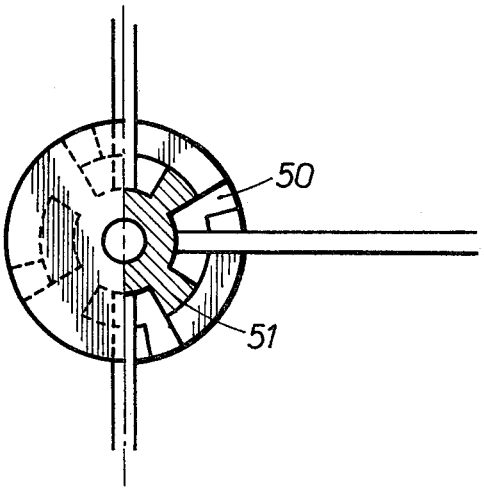

FIGS. 9A–9C show an embodiment in which the central body is made up of two symmetrical parts 46 and 47, each of them having a peripheral groove 48 of approximately rectangular cross-section with a symmetry plane perpendicular to the axis of the central body, the bottom of the groove being formed with a rib 49 that is wider at the surface than at the bottom and is T-shaped in cross-section, the vertical bar of the T or its foot being fixed to the bottom of the groove perpendicularly to the axis of the central body and the cross-bar of the T being parallel to the axis of the central body and flush with the edges of the groove. The peripheral part of the rib includes at least one passage 50 having for dimensions the size of the groove bottom capable of offering a passage to the base of the lug, which has a shape approximately complementary to the groove together with its rib.

FIG. 9C shows in cross-section an embodiment in which the rib is discontinuously formed and extends for instance over two or four sectors of each part of the central body. Each of the sectors is separated from the next one by a longitudinal wall 51 which confers a greater rigidity to the whole device during assembly.

Figure 10A:
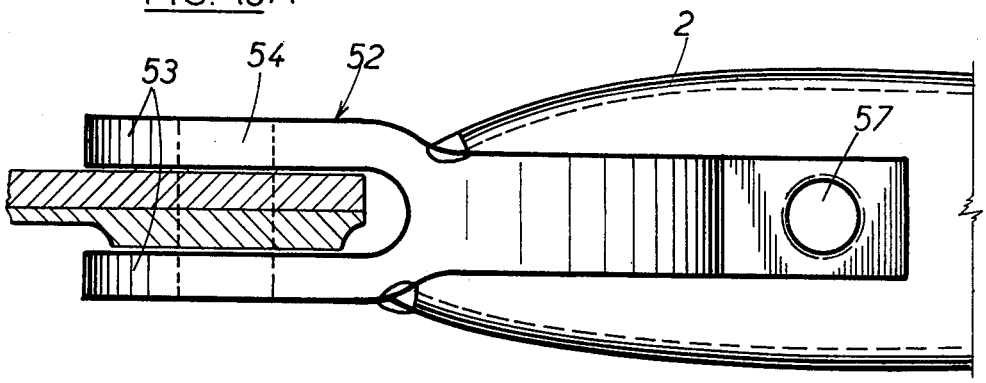
FIGS. 10A and 10B shown an embodiment of a piece for fixing a tube to a lug.
Figure 10B:
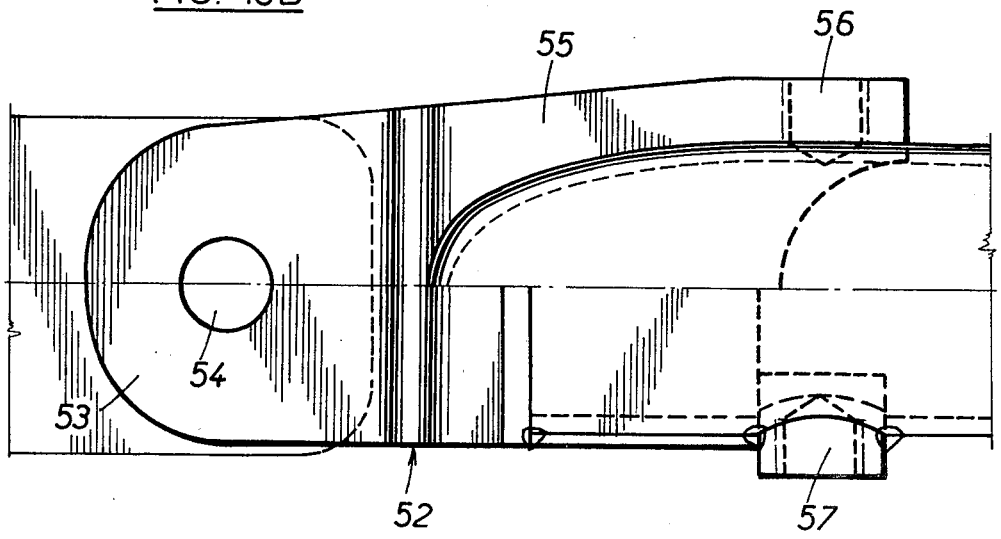

The lugs of the connection pieces are fixed to the structure tubes by fastening elements 52 as shown in FIGS. 1, 10A, and 10B. In the example of embodiment shown, element 52 includes at least a yoke 53 pierced by a bore 54 which is brought in register with the bore of the lug, drilled in terms of the data obtained from the calculation of the application of forces. The linking rod 2 of the structure may be directly welded to this yoke or otherwise maintained.

In the embodiment shown the fastening element 52 carries a second yoke 55 having an axis perpendicular to the one cooperating with the lug. The yoke 55 may present a recess or through-bore 56 for receiving a device which ensures flooding of the rod by a fluid or as shown in FIG. 10A or for receiving tight connection means 57 and corresponds to a bore of the structure rod for ensuring the passage of a cooling or heat-evacuating fluid.

FIG. 1 shows a linking node in which all the fastening elements 52 include connections which are interconnected by pipes 58, the latter feeding to a connection or distribution box 59 which may be connected to the source of heat-evacuating fluid that is, the cooling or heating fluid of the structure. The multidirectional linking system of the invention permits using the structure rods for conveying fluids and in particular permits the disposition of an efficient net of fire protection by cooling of the rods by using at least one bore of a yoke as a watering device. Applications of the linking system are manifold. In particular the system allows the construction of structures having two successive curvatures with two sheets of variable thickness such as those used in static heat exchangers, by altering or not altering the Venturi effect through the same, or in dynamic heat exchangers, incorporated in roof-trees of the "Tuile" shed type possessing a large possibility of transformation. Such structures may be totally assembled on the ground with all their constituent parts and accessories such as roofing, piping, etc.

Standardization of the connection pieces permits shortening delays between the time of the project and the delivery time; it also helps attaining a lower cost because of the universal use of the structure pieces.

Figure 11A:
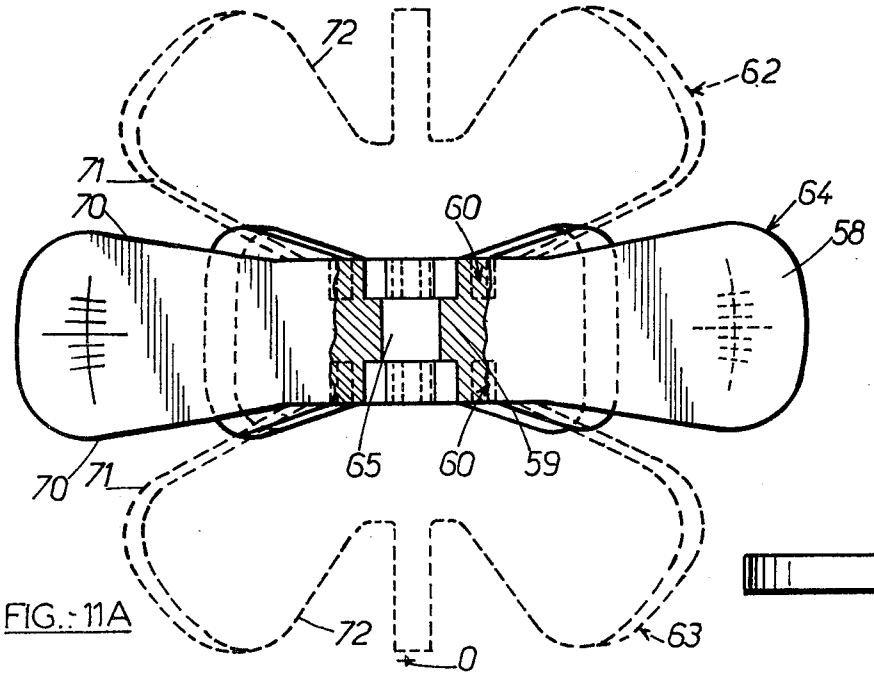
FIGS. 11A and 11B show an elevation view and a partial section view respectively of the two parts of a connection piece, for another embodiment.
Figure 11B:
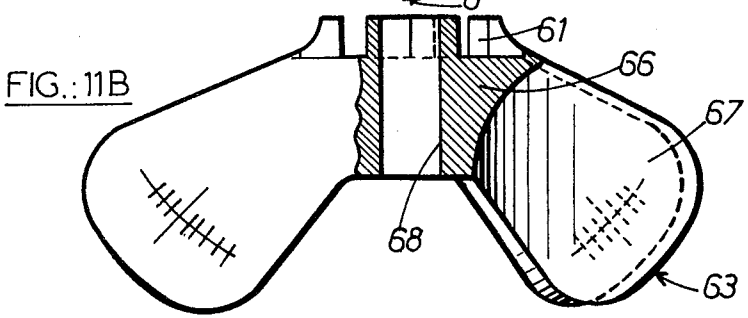

In the embodiment shown in FIGS. 11A–11B, the central body of the connection piece is made up of at least two superimposable parts 63, 64, each of them carrying a lug crown. Part 64 has lugs 58 whose planes are vertical in this example. The central body 59 shows holes 60 into which studs 61 on one of the faces of the second lug crown shown in FIG. 11B may penetrate. The holes that are formed in the two plane, parallel faces of the central body 59 permit constructing a connection piece with three lug crowns, i.e. a central crown 64 according to FIG. 11A and two others, an upper one 62 and a lower one 63 according to FIG. 11B. The central crown 65 may be made, as shown in the examples of FIGS. 7A, 8A, 9A, with removable lugs. The central body from which the lugs 58 stick out has a cylindrical or polygonal shape and is pierced through along its axis by a passage 65 which has at least partly a polygonal form.

The connection pieces shown in FIG. 11B includes a central body 66 wherefrom lugs 67 stick out in a direction at an acute angle with respect to the parallel planes of the central body. According to peculiarity this embodiment the central body has approximately a frusto-conical form, the angle of the cone allowing for an equal transmission of the tension or compression forces acting on the lugs in such manner that the point of concurrence of forces is at the center 0 of the connection piece. This point 0 is situated inside the central body part and coincides with the point of concurrence of forces of the central lug crown 64.

The frusto-conical body carries on its greater base the studs 61 having a form which corresponds to the holes 60 of the central crown 64 and also, along its longitudinal axis, a passage 68 of a cross-section having a polygonal shape alike to the one of the passage 65 of crown 64.

In the embodiment of FIG. 11B, the side surface of the central body shows a concave conformation, which furthers its reduction of weight and ensures a better distribution of the forces acting at the end of the lugs.

According to particular embodiments of the central body of the central crown or the upper and/or lower crown(s), at least part of the body is defined as a rotation volume of a circular or polygonal cross-section, its generatrix being formed of at least one curve or straight line or a combination of curves and/or straight lines.

Figure 12:
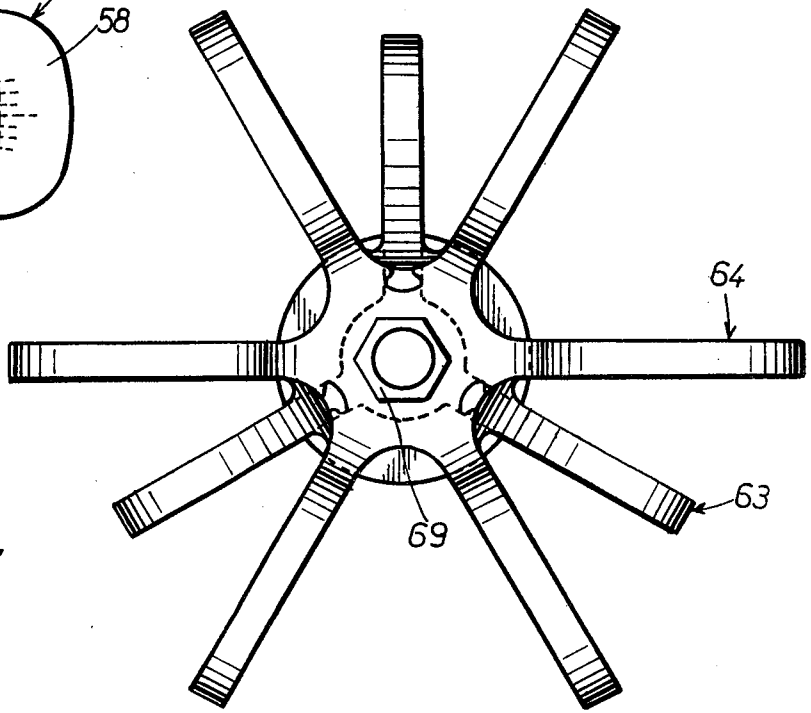
FIG. 12 is a top view of the connection piece of FIGS. 11A–11B.

FIG. 12 is a top view of central crown 64 and lower crown 63. The two parts of the connection piece are interlocked by a clamp such as a screw-unit combination in the axial passage 65, 68. The same axial passage may receive a locating element 69 having a form that corresponds to the passage conformation so as to maintain the lug crowns in position with respect to each other. In the case of this example, the locating element 69 serves to strengthen the angular positioning device formed by the holes 60 and studs 61.

According to another embodiment not shown the device 60, 61 is replaced by the locating element 69.

Just as in the foregoing examples the form of the lugs is chosen so as to admit a positioning of structure rods with eventual given angular deviations $a_1$, $a_2$, $b_1$, $b_2$, with respect to the middle axis of a lug $a_0$, $b_0$, the concurrence in one point 0 situated on the axis of the central body 14 being preserved.

In the embodiment of FIGS. 11A–11B the lugs of the medium and lower and/or upper crowns may be enlarged to a limit which approximately corresponds to tangency of the adjoining edges 70, 71 of the lugs of adjacent crowns 64, 63 and 62, 64. This particular embodiment allows placing the lugs of the lower and/or upper crown(s) in the plane of one or several lugs of the central crown. If continuous positioning over 360° is not wanted the lugs of the lower and/or upper crowns may interpenetrate as shown in FIGS. 5A, 5B; 6A, 6B; 8A, 9A.

In another embodiment not shown, the edges 72 of the lugs of the lower crown 63 and upper crown 62 may be parallel to the axis of the central part, in a border-line case.

Obviously, numerous modifications and variations of the present invention are possible in light of the above teachings. It is therefore to be understood that within the scope of the appended claims, the invention may be practiced otherwise than as specifically described herein.

I claim:

1. A connector for interconnecting a plurality of rods into a spatial structure wherein each of said rods comprises a longitudinal axis, and wherein said connector comprises:

a first central body member having a first longitudinal axis;

a plurality of first lug members projecting radially outwardly from and spaced around said first central body member, each of said first lug members having a central axis directed transverse to and intersecting said longitudinal axis of said first central body member at a predetermined common point;

a second central body member having a second longitudinal axis coaxial with said longitudinal axis of said first central body member and secured to said first central body member;

a plurality of second lug members projecting radially outwardly from and spaced around said second central body portion, each of said second lug members having a central axis directed transverse to and intersecting said second longitudinal axis at said common point;

keying means for detachably connecting and for angularly positioning said first central body member with said second central body member; and marking means indicating a plurality of alignment marks corresponding to a plurality of different points of attachment of said rods with said connector provided on each of said first and second lug members for substantially aligning said longitudinal axes of said rods with said central axes of said first and second lug members within predetermined marked limits, each one of said plurality of alignment marks defining a predetermined angular position formed between said longitudinal axis of each one of said rods and said central axes of said first and second lug members such that interconnection of said rods with said connector via said first and second lug members at any said predetermined angular position transmits and converges forces from said rods to said connector at said common point.

2. A connector as claimed in claim 1 wherein said first central body member comprises a circular cross section.

3. A connector as claimed in claim 1 wherein said first central body member comprises a polygonal cross section.

4. A connector as claimed in claim 1 wherein said first central body member comprises an axis passage formed therein.

5. A connector as claimed in claim 4, wherein said keying means comprises a polygonal positioning element cooperating with said axial passage.

6. A connector as claimed in claim 1 further comprising a third central body member secured to said first central body member and wherein said second and third central body members each comprise a frusto-conical shape.

7. A connector as claimed in claim 1 wherein at least one of said plurality of first lug members is disposed in a co-planar relationship with one of said second lug members.

* * * * *